US009004883B2

(12) United States Patent
Neelakantan et al.

(10) Patent No.: US 9,004,883 B2
(45) Date of Patent: Apr. 14, 2015

(54) LOW NOISE HIGH EFFICIENCY SOLENOID PUMP

(75) Inventors: Vijay A. Neelakantan, Rochester Hills, MI (US); Paul G. Otanez, Troy, MI (US); Shushan Bai, Ann Arbor, MI (US)

(73) Assignee: GM Global Technology Operations, LLC, Detroit, MI (US)

( * ) Notice: Subject to any disclaimer, the term of this patent is extended or adjusted under 35 U.S.C. 154(b) by 227 days.

(21) Appl. No.: 13/078,085

(22) Filed: Apr. 1, 2011

(65) Prior Publication Data

US 2012/0251359 A1 Oct. 4, 2012

(51) Int. Cl.
*F04B 17/04* (2006.01)
*F04B 11/00* (2006.01)

(52) U.S. Cl.
CPC ..... *F04B 11/0058* (2013.01); *F04B 17/046* (2013.01)

(58) Field of Classification Search
USPC ..... 417/417, 416, 410.1, 415, 470
See application file for complete search history.

(56) References Cited

U.S. PATENT DOCUMENTS 6,323,568 B1 * 11/2001 Zabar ..... 310/17
6,526,746 B1 * 3/2003 Wu ..... 60/286
6,554,588 B1 * 4/2003 DiBenedetto ..... 417/417
7,094,041 B2 * 8/2006 Hashimoto et al. ..... 417/417
7,316,545 B2 * 1/2008 Lenke ..... 417/274
7,665,510 B2 * 2/2010 Nara et al. ..... 165/104.28
7,981,107 B2 * 7/2011 Olsen ..... 604/891.1
2004/0241017 A1 * 12/2004 Buzzi ..... 417/415
2005/0025638 A1 * 2/2005 Buffet ..... 417/416
2005/0089418 A1 * 4/2005 Bonfardeci et al. ..... 417/417
2009/0047154 A1 * 2/2009 Choi et al. ..... 417/417
2009/0232666 A1 * 9/2009 Choi et al. ..... 417/212
2009/0304525 A1 * 12/2009 Reinschke ..... 417/53

OTHER PUBLICATIONS

"Damping", 2009, Wikipedia.*

* cited by examiner

*Primary Examiner* — Christopher Bobish

(57) ABSTRACT

A low noise, high efficiency solenoid pump includes a housing containing a hollow electromagnetic coil. Within the coil resides a pump assembly defining a tubular body having a pair of opposed ends which respectively include an inlet or suction port and an outlet or pressure port and within which a plunger or piston resides. The piston is biased in opposite directions by a pair of opposed compression springs. A first compression spring limits and arrests travel of the piston during the suction or return stroke and a second compression spring limits travel of the piston during the pumping stroke and returns the piston after the pumping stroke. The piston includes a first check valve that opens to allow hydraulic fluid into a pumping chamber during the suction stroke and closes during the pumping stroke to cause fluid to be pumped out of the pumping chamber. A second check valve opens to allow pumped fluid to exit the pumping chamber and the pump body through the outlet or pressure port and closes to inhibit reverse flow.

15 Claims, 2 Drawing Sheets

LOW NOISE HIGH EFFICIENCY SOLENOID PUMP

FIELD

Figure 1:
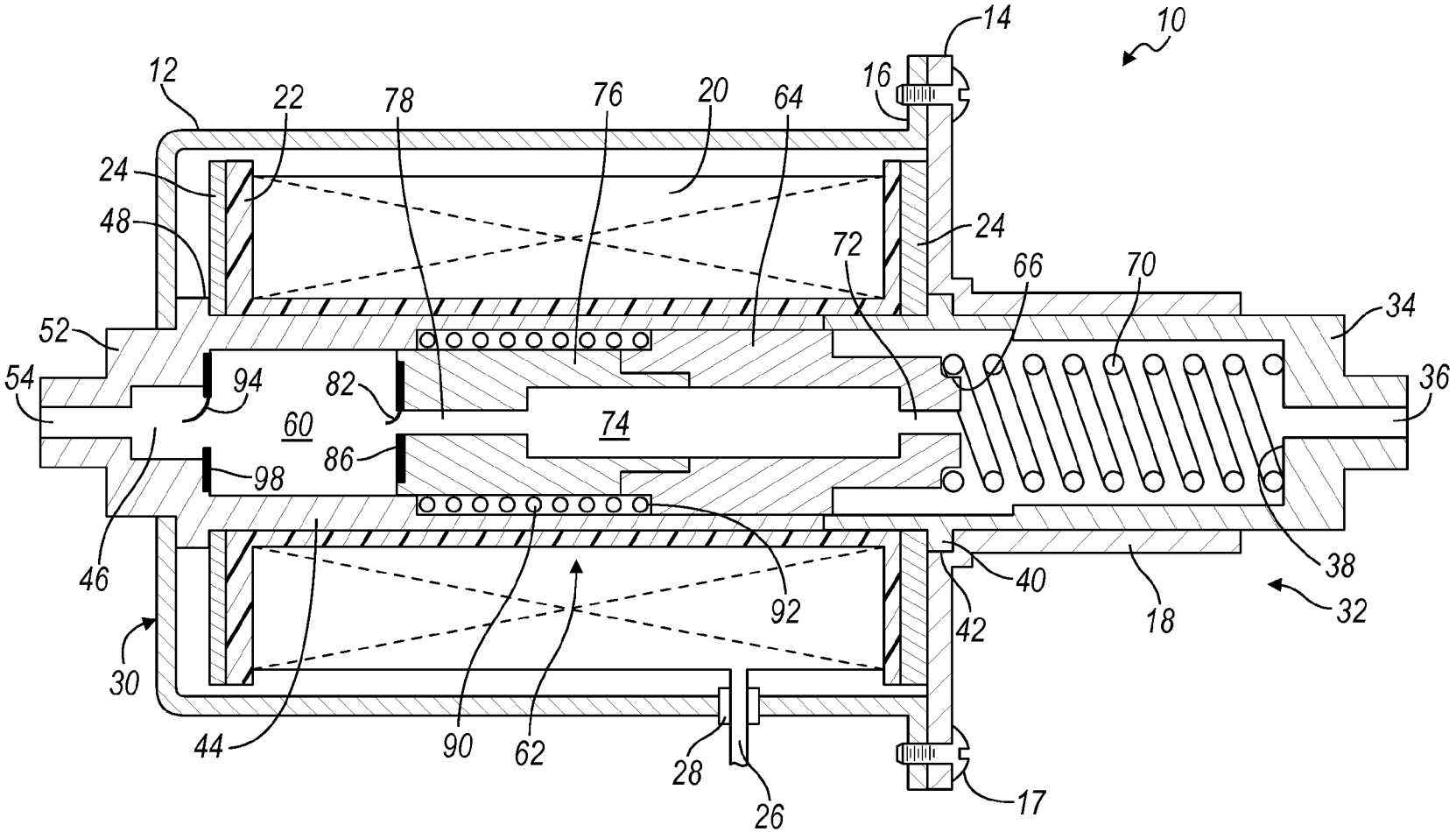

The present disclosure relates to solenoid pumps and more particularly to a low noise, high efficiency solenoid pump.

BACKGROUND

The statements in this section merely provide background information related to the present disclosure and may or may not constitute prior art.

One of the many operational schemes for passenger cars and light trucks that is under extensive study and development in response to ever increasing consumer demands and federal mileage requirements is referred to as engine start stop (ESS). This operational scheme generally involves shutting off the gasoline, Diesel or flex fuel engine whenever the vehicle is stopped in traffic, that is, whenever the vehicle is in gear but stationary for longer than a short, relatively predictable time, such as occurs at a traffic light or in stop-and-go traffic.

While this operational scheme has a direct and positive impact on fuel consumption, it is not without engineering and operational complications. For example, since the engine output/transmission input shaft does not rotate during the stop phase, automatic transmissions relying for their operation upon pressurized hydraulic fluid provided by an engine driven pump may temporarily lose pressure and thus gear and clutch selection and control capability. This shortcoming can, however, be overcome by incorporating various hydraulic components such as accumulators or electrically driven pumps in the hydraulic control circuit at strategic locations. Such accumulators, since the are essentially passive devices, depend upon both engine operating cycles of sufficient length to fully charge the accumulator(s) and stationary engine cycles or periods of sufficient brevity that the accumulator(s) do not become discharged. Since pumps are active devices, they do not suffer from these shortcomings. Many pump designs, especially gear and rotor pumps do, however, tend to be more expensive than accumulators and, of course, require electrical supply and control components.

The cost and complexity of gear and gerotor pumps have directed attention to another type of pump, the solenoid pump. Solenoid pumps have become popular in engine start stop applications, not only for their lower cost but also because their generally somewhat limited flow and pressure output is a good match for engine start stop transmission applications.

The application is not without challenges, however, one of which is ironic. During the engine stop cycle, vehicle powertrain noise is essentially non-existent. This, of course, is typically the only time an auxiliary or supplemental hydraulic pump will be called upon to provide pressurized hydraulic fluid for the transmission. Unfortunately, solenoid pumps, which pump by cyclic energization of a coil and the resulting reciprocation of a piston, tend to create a certain amount of pulsation noise. Such pulsation noise is detectable and can be objectionable, again primarily because the vehicle is otherwise quiet during the engine stop cycle.

It is apparent, therefore, that a solenoid pump having reduced operating noise would be highly desirable. The present invention is so directed.

SUMMARY

The present invention provides a low noise, high efficiency solenoid pump. The solenoid pump includes a housing containing a hollow electromagnetic coil. Within the coil resides a sealed pump assembly defining a tubular body having a pair of opposed ends which respectively include an inlet or suction port and an outlet or pressure port and within which a plunger or piston resides. The piston is biased in opposite directions by a pair of opposed compression springs. A first compression spring limits and snubs travel of the piston during the suction or return stroke (and assists the pumping stroke) and a second compression spring limits and snubs travel of the piston during the pumping stroke and returns the piston after the pumping stroke. The piston includes a first check valve that opens to allow hydraulic fluid (transmission oil) into a pumping chamber during the suction stroke and closes during the pumping stroke to cause fluid to be pumped out of the pumping chamber. A second check valve, aligned with the first check valve, opens to allow pumped (pressurized) fluid to exit the pumping chamber and the pump body through the outlet or pressure port and closes to inhibit reverse flow.

The spring rates of the two compression springs and the mass of the piston are chosen to provide a mechanical system having a harmonic frequency of vibration that coincides closely with the frequency of the impulses applied to the electromagnetic coil of the solenoid to reciprocate the piston. Thus, the piston is driven at and reciprocates or oscillates at its damped natural frequency of vibration, thereby reducing energy consumption and rendering the solenoid highly efficient. The compression springs reduce the steady and repeated noise pulses associated with the direction reversal of the piston at the end of its strokes by absorbing energy from the piston and relatively slowly reversing its direction of translation.

Thus it is an aspect of the present invention to provide a solenoid pump.

It is a further aspect of the present invention to provide a low noise solenoid pump.

It is a still further aspect of the present invention to provide a low noise, high efficiency solenoid pump.

It is a still further aspect of the present invention to provide a low noise, high efficiency solenoid pump.

It is a still further aspect of the present invention to provide a solenoid pump having a piston and a pair of opposed springs engaging and biasing the piston.

It is a still further aspect of the present invention to provide a solenoid pump having a piston and springs which comprise a mechanical system having a natural frequency of vibration the same as the electromagnetically induced speed of reciprocation.

It is a still further aspect of the present invention to provide a solenoid pump having a pair of check valves.

Further aspects, advantages and areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

Figure 2:
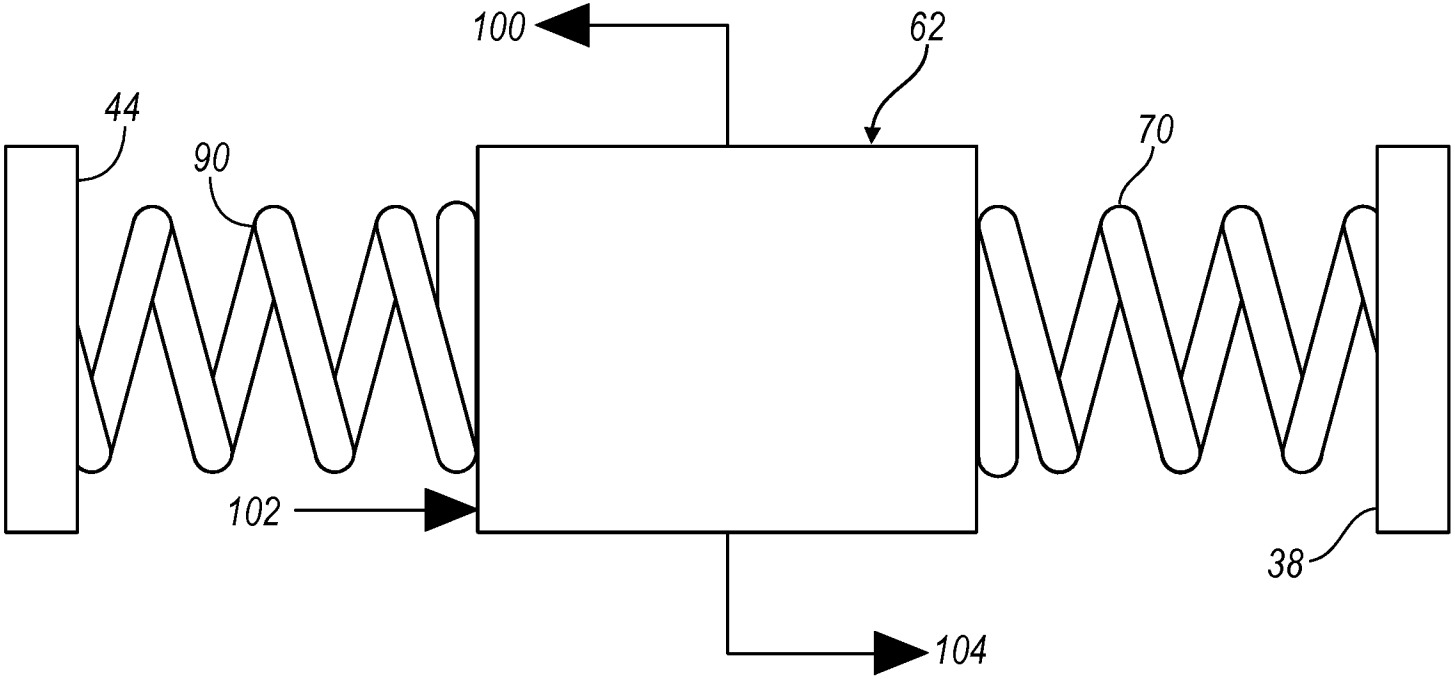

FIG. 1 is a full sectional view of a solenoid pump according to the present invention; and FIG. 2 is a diagrammatic view of the forces acting upon a piston assembly of a solenoid pump according to the present invention.

DETAILED DESCRIPTION

The following description is merely exemplary in nature and is not intended to limit the present disclosure, application, or uses.

With reference to FIG. 1, a solenoid pump according to the present invention is illustrated and generally designated by the reference number 10. The solenoid pump 10 includes a generally tubular or cylindrical deep drawn typically metal housing 12 which is closed at one end by a circular disc or end plate assembly 14 suitably secured to an end flange 16 or similar structure of the tubular housing 12 by any suitable fastening means such as threaded fasteners 17. The end plate assembly 14 also includes a tubular extension 18. The tubular housing 12 receives an electromagnetic coil 20 which is wound on an insulating bobbin 22. At each end of the bobbin 22 is a circular metal retaining disc 24 which also functions to concentrate the magnetic flux of the electromagnetic coil 20. An electrical lead or leads 26 pass through the tubular housing 12 in a suitable insulating feed-through 28 and provide electrical energy to the electromagnetic coil 20.

Concentrically disposed within the hollow bobbin 22 of the electromagnetic coil 20 is a pump assembly 30 which includes a fluid tight elongate pump body 32. The pump body 32, for ease of manufacturing, preferably comprises two aligned sections. A first generally tubular elongate section 34 is received within the tubular extension 18 and defines an inlet port 36 surrounded by an interior shoulder or surface 38 and an exterior shoulder or flange 40 that is engaged by a complementary groove or channel 42 formed in the circular disc or end plate assembly 14. Sealingly and axially aligned with the first tubular section 34 is a second tubular section 44 defining a pressurized fluid outlet chamber 46 and an exterior shoulder or flange 48 that is engaged by the adjacent circular retaining disc 24. Aligned with and sealed to the second tubular section 44 is an outlet housing or section 52 which defines an outlet port 54 which is aligned with the fluid outlet chamber 46.

The first tubular elongate section 34 and the second tubular section 44 define an elongate, hollow, fluid tight, cylindrical pumping chamber 60. Slidably disposed within the pumping chamber 60 is a piston assembly 62. The piston assembly 62 preferably includes a first, ferrous, i.e., magnetic, plunger or armature portion 64. Aligned with the end of the plunger or armature portion 64 and retained thereon by a circumferential groove 66 is a first compression spring 70 that extends to the interior shoulder or surface 38 of the first tubular elongate section 34. The first compression spring 70 has a spring rate selected in accordance with the design constraints described below.

The plunger or armature portion 64 also defines a first axial throat or passageway 72 which provides fluid communication between the inlet port 36 and an enlarged interior axial chamber or passageway 74 within the armature or plunger portion 64. The piston assembly 62 preferably also includes a second, non-magnetic body or member portion 76, which may be either metallic or non-metallic, through which the axial chamber or passageway 74 also extends. If desired, however, the piston assembly 62 may be a single piece, single material component.

The second body or member portion 76 defines a second axial throat or passageway 78 aligned with the passageway 74 and the first axial throat or passageway 72 which is terminated and selectively closed off by a first one-way check or reed valve 82 which is self-biased against a circular shoulder or ridge 86 to close off the axial passageway 74. Alternatively, the first one-way check or reed valve 82 may be a ball check or poppet valve having a compression spring (all not illustrated). A second compression spring 90 concentrically disposed about the piston assembly 62 engages a shoulder 92 on the first plunger or armature portion 64 and biases the piston assembly 62 to the right as illustrated in FIG. 1, toward the inlet port 36, in a direction opposite to the bias provided by the first compression spring 70. The second compression spring 90 has a spring rate selected in accordance with the design constraints described below. Typically, though not necessarily, the second compression spring 90 will be shorter than and have a higher spring rate than the first compression spring 70.

Between the pumping chamber 60 and the pressurized fluid outlet chamber 46 is a second one-way check or reed valve 94 which is self-biased against a circular shoulder or ridge 98 to selectively close off fluid communication between the pumping chamber 60 and the pressurized fluid outlet chamber 46. Alternatively, the second one-way check or reed valve 94 may be a ball check or poppet valve having a compression spring (all not illustrated).

Referring now to FIGS. 1 and 2, in order to enjoy the benefits of the present invention, it is necessary to select or consider certain physical and operational parameters such as the mass of the piston assembly 62, the spring rates of the compression springs 70 and 90, the nominal operating pressure of the solenoid pump 10 and the frequency of excitation of the electromagnetic coil 20 so that the damped natural frequency of vibration (the resonant frequency) of the piston assembly 62 is the same as or essentially the same as the frequency of excitation of the electromagnetic coil 20.

In FIG. 2, the arrow 100 pointing to the left represents the pumping force ($F_{sol}$) on the piston assembly 62 exerted by the electromagnetic coil 20, the arrow 102 pointing to the right represents the damping force exerted on the piston assembly 62 and the arrow 104 also pointing to the right represents the force or resistance ($F_{hyd}$) exerted on the piston assembly by the hydraulic fluid. The general motion equation of a mechanical system illustrated in FIG. 2 is $$m\ddot{x}+b\dot{x}+kx=F_{sol}-F_{hyd} \tag{1}$$

wherein the terms $F_{sol}-F_{hyd}$ represent the force generated by the piston assembly 62 minus that force utilized by or absorbed in pumping the hydraulic fluid. The natural frequency (resonance) of vibration of a mechanical system is given by $$\omega_n = \sqrt{\frac{k}{m}} \tag{2}$$

and the damping ratio (factor) is given by $$\zeta = \frac{c}{2\sqrt{km}} \tag{3}$$

wherein m is the mass of the piston assembly 62, k is the spring rate and c is the damping coefficient. Hence, the mechanical system's damped natural frequency of vibration is $$\omega_d=\omega_n(\sqrt{1-\zeta^2}) \tag{4}$$

Once the damping of the mechanical system is determined empirically or by experiment, it is necessary to achieve a "k" such that the system's damped natural frequency of vibration matches the excitation frequency of the electromagnetic coil 20. For example, if the electromagnetic coil 20 is excited at 60 Hz PWM, then $$\omega_d = 2\pi(60) = \sqrt{\frac{k}{m}}\left(\sqrt{1-\frac{c^2}{4km}}\right) \quad (5)$$

Hence, $$\omega_d = 2\pi(60) = \frac{1}{2m}\left(\sqrt{4km - c^2}\right) \quad (6)$$

And therefore, $$k = \frac{4m^2\omega_d^2 + c^2}{4m} \quad (7)$$

An additional constraint that must be considered in the design of the solenoid pump 10 is that the force produced by the electromagnetic coil 20 on the piston assembly 62 must be high enough to overcome the force of the second compression spring 90 and to produce the fluid displacement (output) required of the solenoid pump 10, in this case $$F_{sol} > kx + F_{hyd} \quad (8)$$

The operation of the solenoid pump 10 is straightforward. Assuming the solenoid pump 10 is filled with a fluid such as hydraulic fluid or transmission oil, when the electromagnetic coil 20 is energized, the piston assembly 62 translates to the left in FIG. 1, assisted by the force of the first compression spring 70 and resisted by the force of the second compression spring 90, drawing in fluid through the inlet port 36 and forcing fluid at the left end of the piston assembly 62 past the second poppet or check valve 94 and out the outlet port 54. When the electromagnetic coil 20 is de-energized, the piston assembly 62 translates to the right, assisted by the force of the second compression spring 90 and resisted by the force of the first compression spring 70. The first poppet or check valve 82 opens and fluid flows from the right end of the pumping chamber 60, through the axial passageway 74, past the first poppet valve 82 and into the left end of the pumping chamber 60. The pumping cycle is then repeated as the electromagnetic coil 20 is re-energized.

While the frequency at which the electromagnetic coil 20 is cyclically energized and de-energized first of all affects the volume and pressure of fluid pumped by the solenoid pump 10, there are other consequences and ramifications. For example, the faster the piston assembly 62 reciprocates the more noise is generated by the solenoid pump 10. This is especially true if the momentum of the piston assembly 62, because of its linear speed, causes the first compression spring 70 to stack or become solid. Furthermore, causing the mechanical system of the piston assembly 62 and the first and the second compression springs 70 and 90 to operate or reciprocate at a frequency other than their natural frequency of vibration or a harmonic thereof requires significant additional energy.

Thus, in the present invention, the mass of the piston assembly 62 and the forces of the first and the second compression springs 70 and 90 applied to it are chosen so that at a nominal, desired output flow and pressure, the mechanical system of the piston assembly 62 and the compression springs 70 and 90 operate or reciprocate at their damped natural frequency of vibration or a harmonic thereof as set forth above. Furthermore, these variables are chosen so that in normal operation, the piston assembly 62 does not bottom out on the compression springs 70 and 90, that is, the translation and reciprocation of the piston assembly 62 is such that it never causes the compression springs 70 and 90 to stack or become solid.

Thus, a solenoid pump 10 according to the present invention operates more quietly than conventional solenoid pumps because the piston assembly 62 is accelerated and decelerated not only more slowly but also in conformance with its natural frequency of vibration or a harmonic thereof. This operating mode, in turn, provides improved energy efficiency since the reciprocation of the piston assembly 62 conserves energy by operating at its damped natural frequency of vibration.

The description of the invention is merely exemplary in nature and variations that do not depart from the gist of the invention are intended to be within the scope of the invention. Such variations are not to be regarded as a departure from the spirit and scope of the invention.

What is claimed is:

1. A low noise solenoid pump comprising, in combination, a housing, an insulating bobbin having a hollow interior and a pair of opposed ends, an electromagnetic coil disposed on said bobbin, flux concentrating metal discs disposed adjacent each of said ends of said bobbin, a multiple piece pump body disposed within said hollow interior of said bobbin and defining a pumping chamber, said pump body comprising a first section having a first flange disposed between said housing and one of said flux concentrating discs and defining an inlet port, and a second section having a second flange disposed between said housing and another of said flux concentrating discs and defining an outlet port, a metal piston disposed in said pump body, said piston having a first magnetic, armature portion and a second non-magnetic, body portion, said piston defining a through passageway and having a first check valve operably disposed between said through passageway and said pumping chamber, a second check valve disposed in said second section between said pumping chamber and said outlet port, a first compression spring disposed between said piston and said first section of said pump body adjacent said inlet port and biasing said piston in a first direction, and a second compression spring disposed between said piston and said second section of said pump body and biasing said piston in a second direction, opposite to said first direction, wherein said piston and said compression springs constitute a mechanical system and said electromagnetic coil is energized and de-energized at a damped natural frequency of vibration of said mechanical system.

2. The low noise solenoid pump of claim 1 wherein said damped natural frequency of vibration of said mechanical system equals $$\omega_n\sqrt{1-\frac{c^2}{4km}}$$

where $\omega_n$ equals the natural frequency of vibration, c is the damping coefficient, k is the spring rate and m is the mass.

3. The low noise solenoid pump of claim 1 wherein said first and said second check valves are reed valves.

4. The low noise solenoid pump of claim 1 wherein said through passageway in said piston includes an enlarged diameter center portion and at least one reduced diameter end portion.

5. A solenoid pump comprising, in combination, a housing, an insulating bobbin having a hollow interior and a pair of opposed ends, an electromagnetic coil disposed on said bobbin, flux concentrating metal discs disposed adjacent each of said ends of said bobbin, a multiple piece pump body disposed within said hollow interior of said electromagnetic coil, said pump body comprising a first section having a first flange disposed between said housing and one of said flux concentrating discs and defining an inlet and a second section having a second flange disposed between said housing and another of said flux concentrating discs and defining a pumping chamber and an outlet, a metal piston disposed in said pump body and having a first magnetic, armature portion and a second non-magnetic, body portion, said piston defining a through passageway and having a first check valve operably disposed between said through passageway and said pumping chamber, a second check valve disposed in said second section between said pumping chamber and said outlet, a first compression spring disposed between said piston and said first section of said pump body adjacent said inlet and biasing said piston in a first direction, and a second compression spring disposed between said piston and said second section of said pump body and biasing said piston is a second direction, opposite to said first direction, wherein said piston and said compression springs constitute a mechanical system and said electromagnetic coil is energized and de-energized at a rate corresponding to a damped natural frequency of vibration of said mechanical system.

6. The solenoid pump of claim 5 wherein said first and said second check valves are reed valves.

7. The solenoid pump of claim 5 wherein the housing is a tubular housing for receiving said electromagnetic coil and includes openings for said inlet and said outlet.

8. The solenoid pump of claim 5 wherein said through passageway in said piston defines an enlarged diameter center portion and reduced diameter end portions.

9. The solenoid pump of claim 5 wherein said damped natural frequency of vibration of said mechanical system equals $$\omega_n\sqrt{1-\frac{c^2}{4km}}$$

where $\omega_n$ equals the natural frequency of vibration of said mechanical system, c is the damping coefficient, k is the spring rate and m is the mass.

10. A high efficiency solenoid pump comprising, in combination, a housing, an insulating bobbin disposed within said housing and having a hollow interior and a pair of ends, an electromagnetic coil disposed within said housing and on said bobbin, flux concentrating metal discs disposed adjacent each of said ends of said bobbin, a multiple piece pump body disposed within said hollow interior of said bobbin, said pump body including a first section including a first flange disposed between said housing and one of said flux concentrating discs and defining an inlet port and a second section aligned with said first section and including a second flange disposed between said housing and another of said flux concentrating discs, a pumping chamber and an outlet port, a metal piston disposed in said pump body, said piston having a first magnetic, armature portion and a second non-magnetic, body portion, the piston defining a through passageway and having a first check valve operably disposed between said through passageway and said pumping chamber, a second check valve disposed in said second section between said pumping chamber and said outlet port, a first compression spring disposed between said piston and said first section of said pump body adjacent said inlet port and biasing said piston in a first direction, and a second compression spring disposed between said piston and said second section of said pump body and biasing said piston is a second direction, opposite to said first direction, whereby said piston and said compression springs constitute a mechanical system and said electromagnetic coil is cyclically energized and de-energized at a fixed frequency corresponding to a damped natural frequency of vibration of said mechanical system.

11. The high efficiency solenoid pump of claim 10 wherein said first and said second check valves are reed valves.

12. The high efficiency solenoid pump of claim 10 wherein said housing includes openings for said inlet port and said outlet port.

13. The high efficiency solenoid pump of claim 10 wherein said through passageway in said piston includes an enlarged diameter region.

14. The high efficiency solenoid pump of claim 10 wherein said first compression spring is longer than said second compression spring.

15. The high efficiency solenoid pump of claim 10 wherein said piston is fabricated of ferrous material.

* * * * *